US005881696A

United States Patent [19]

Wada

[11] Patent Number: 5,881,696

[45] Date of Patent: Mar. 16, 1999

[54] ENGINE CONTROL APPARATUS

[75] Inventor: Shuichi Wada, Hyogo, Japan

[73] Assignee: Mitsubishi Denki Kabushiki Kaisha, Tokyo, Japan

[21] Appl. No.: 968,473

[22] Filed: Nov. 12, 1997

[30] Foreign Application Priority Data

Apr. 30, 1997 [JP] Japan ..... 9-112759

[51] Int. Cl.[6] ..... F02P 5/15

[52] U.S. Cl. ..... 123/406.62; 123/488; 123/617

[58] Field of Search ..... 123/414, 476–480, 123/488, 612–617; 73/118.1, 117.3, 116

[56] References Cited

U.S. PATENT DOCUMENTS

| | | | |
|---|---|---|---|
| 4,384,561 | 5/1983 | Komurasaki et al. | 123/414 |
| 4,442,822 | 4/1984 | Kondo et al. | 123/414 |
| 5,014,669 | 5/1991 | Takasaki et al. | 123/414 |
| 5,156,125 | 10/1992 | Fukui et al. | 123/416 |
| 5,363,817 | 11/1994 | Ikeda et al. | 123/90.17 |
| 5,400,747 | 3/1995 | Tabata et al. | 123/90.17 |
| 5,621,644 | 4/1997 | Carson et al. | 123/414 |
| 5,671,714 | 9/1997 | Fukui et al. | 123/414 |

FOREIGN PATENT DOCUMENTS 2-308947 12/1990 Japan .

*Primary Examiner*—Erick R. Solis
*Attorney, Agent, or Firm*—Sughrue, Mion, Zinn, Macpeak & Seas, PLLC

[57] ABSTRACT

It is intended to automatically correct for ignition timing of the engine and fuel injection timing of the engine even if they changed in the case where the attached position of a cam angle sensor is offset after change of distributors and therefore the reference angle is offset. The crank angle and the cam angle of an engine are detected. The phase difference between these angles is computed. The result is reflected in the ignition timing and the fuel injection timing.

11 Claims, 11 Drawing Sheets

ENGINE CONTROL APPARATUS

BACKGROUND OF THE INVENTION

1. Field of the Invention

The present invention relates to an engine control apparatus that controls the ignition timing and the fuel injection timing of an engine.

2. Description of the Related Art

A conventional engine control apparatus detects the angle of revolution of the camshaft which makes a ½ revolution with relation to one revolution of the crankshaft of the engine, by a signal from a cam angle sensor attached within the distributor. From the angle of revolution of the camshaft (cam angle), predetermined angles before top dead center (TDC) of the crankshaft angle (e.g., BTDC 75° and BTDC 5°) are obtained indirectly as reference angles, and based on the reference angles, the ignition control of the engine is performed and the injection control of the fuel is performed.

In such an engine control apparatus, when the attached position of the cam angle sensor is offset due to removal of the distributor for example, reference angle adjustment is performed as a state of fixed ignition timing regardless of the operating state of the engine by moving the distributor to adjust the attached position of the cam angle sensor by a person, as is disclosed for example in Japanese Patent Laid-Open No. 2-308947.

BRIEF SUMMARY OF THE INVENTION

Object of the Invention

As described above, since the prior art performs reference angle adjustment by adjusting the attached position of the cam angle sensor by a person when the distributor is removed for example, the prior art has the disadvantage that it takes time to obtain a proper reference angle and therefore fuel efficiency becomes worse. The prior art also has the disadvantage that errors occur in the reference angle and therefore it is difficult to perform ignition and fuel injection at the proper times.

This invention has been made in order to eliminate the aforementioned problems. Accordingly, the object of the invention is to provide an engine control apparatus which is capable of automatically correcting for ignition timing and fuel injection timing even if they changed in the case where the attached position of a cam angle sensor is offset after removal of the distributor, for example, and therefore the reference angle is offset.

SUMMARY OF THE INVENTION

To achieve the aforementioned object, there is provided an engine control apparatus which comprises crank angle detection means for detecting a crank angle of an engine, cam angle detection means for detecting a cam angle of the engine, phase difference computation means for computing a phase difference between the crank angle and the cam angle from the result of the detection of the crank angle detection means and the result of the detection of the cam angle detection means, and timing control means for performing correction of the control timing of the engine, based on the result of the phase difference computation by the phase difference computation means.

The aforementioned timing control means may also perform correction of the ignition timing of the engine, based on the phase difference computation result.

In addition, the timing control means may also perform correction of the fuel injection timing of the engine, based on the phase difference computation result.

The engine control apparatus may also include phase difference average computation means for computing an average value of the phase differences computed by the phase difference computation mean. The timing control means may then perform correction operation, based on the average value of the phase differences.

In addition, the engine control apparatus may also include engine speed detection means for detecting engine speed and judgment means which judges whether or not the detected engine speed is within a range of predetermined speed. When it is judged that the engine speed is not within the range of predetermined speed, the judgement means judges that phase difference computation conditions are unestablished, with respect to the phase difference computation means.

Furthermore, the engine control apparatus may also include speed variation detection means for detecting a variation in the speed of the engine and judgment means which judges whether or not the variation in the speed of the engine detected is greater than a predetermined value. When it is judged that the variation is greater than the predetermined value, the judgement means judges that phase difference computation conditions are unestablished, with respect to the phase difference computation means.

Moreover, the engine control apparatus also includes engine flameout detection means for detecting flameout state of the engine and judgment means which, when the flameout state of the engine is detected, judges that phase difference computation conditions are unestablished, with respect to the phase difference computation means.

Additionally, the engine control apparatus may also include crank angle sensor failure detection means for detecting failure of the crank angle sensor and judgment means which, when the failure of the crank angle sensor is detected, judges that phase difference computation conditions are unestablished, with respect to the phase difference computation means.

The aforementioned phase difference computation means may also compute a phase difference between the crank angle and the cam angle for each cylinder, and based on the result of the phase difference computation, the timing control means may also perform correction of the control timing of the engine.

BRIEF DESCRIPTION OF THE DRAWINGS

The above and other objects and advantages of the present invention will become apparent from the following detailed description when read in conjunction with the accompanying drawings, in which.

DETAILED DESCRIPTION OF THE PREFERRED EMBODIMENTS (First Embodiment)

Figure 1:
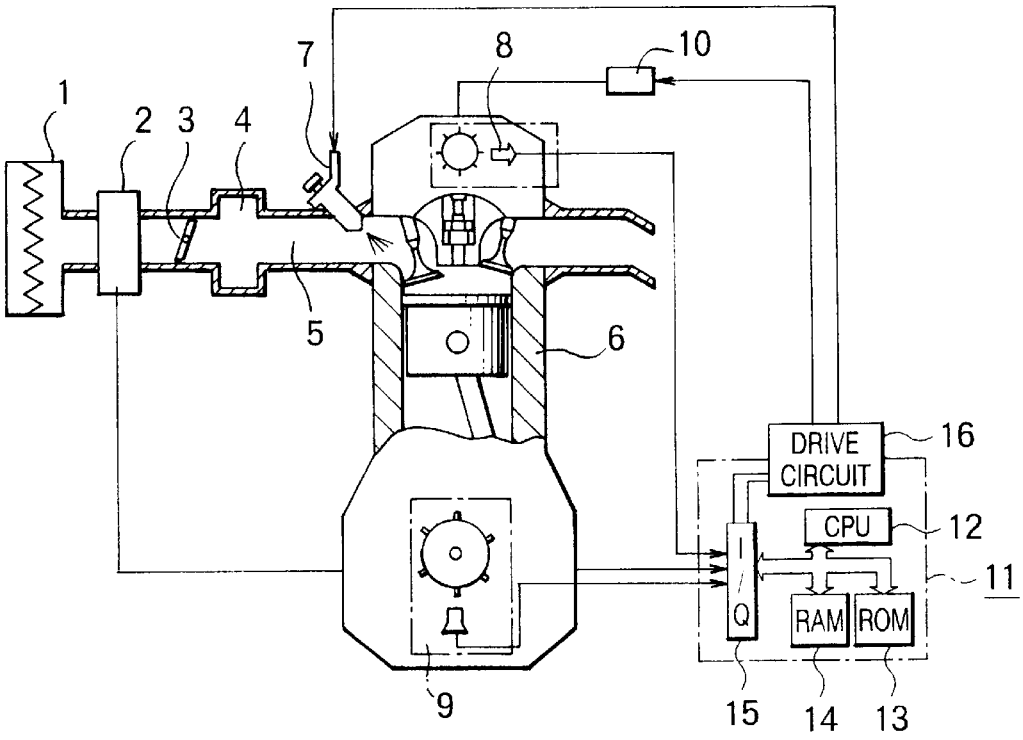
FIG. 1 is a schematic view of an engine control apparatus according to this invention.

Referring to FIG. 1, there is shown an engine control apparatus of this embodiment including a main body and intake and exhaust manifolds. Sucked air passes through an air cleaner 1 which filters air. The intake air flow Qa is measured with an air flow sensor 2 connected to the air cleaner 1. The intake air flow that is admitted into an engine 6 is controlled according to engine load by a throttle valve 3 and is admitted through a surging tank 4 and an intake manifold 5 into the cylinders of the engine 6. Fuel is injected into the intake manifold 5 through an injector 7 and the engine 6 is ignited by an ignition device 10 such as an ignition coil.

An engine control unit 11 receives operating state information, such as reference angle (e.g., BTDC 75° and BTDC 5°) from a cam angle sensor (cam angle detection means) attached to a cam shaft (not shown) and engine speed Ne, and processes this operating state information to perform air-fuel ratio control and ignition timing control.

Describing in detail, the engine control unit 11, as with ordinary microcomputers, is constituted by a CPU 12, ROM 13, RAM 14, and a drive circuit 16 which outputs a drive signal based on the computation result of the CPU 12 to the engine. An input-output interface 15 receives operating state information, such as the intake air flow Qa measured by the air flow sensor 2, reference angle SG measured by the cam angle sensor 8, engine speed Ne, filling efficiency Ec computed from the intake air flow and the engine speed, and crank reference angle SC measured by a crank angle sensor (crank angle detection means) 9 attached to a crankshaft (not shown).

The CPU 12 makes an ignition timing control computation and an air-fuel ratio feedback control computation, based on a control program and various maps stored on the ROM 13 on the base of the operating state information input through the input-output interface 15, and then outputs an ignition signal and a fuel injection signal to the ignition device 10 and the injector 7 through the input-output interface 15 and the drive circuit 16 to drive the engine.

Note that the engine control unit 11 constitutes phase difference computation means, phase difference average computation means, timing control means, engine speed detection means, speed variation means, judgment means, engine flameout detection means, and crank angle sensor failure detection means.

Figure 2:
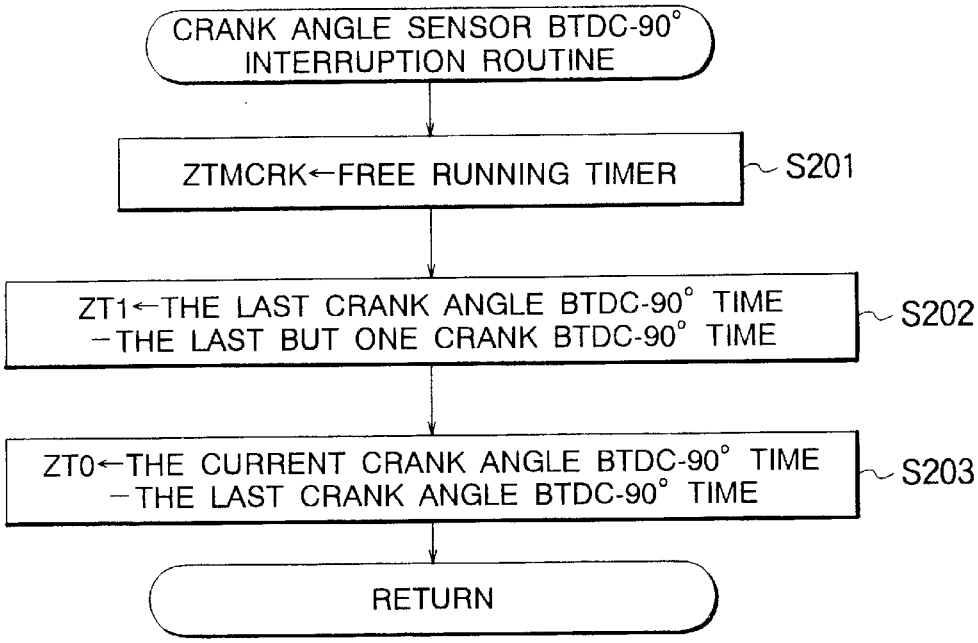
FIG. 2 is a flowchart for explaining the operation of computation of the cycle of the crank angle sensor of an engine control apparatus according to a first embodiment of the present invention.
Figure 3:
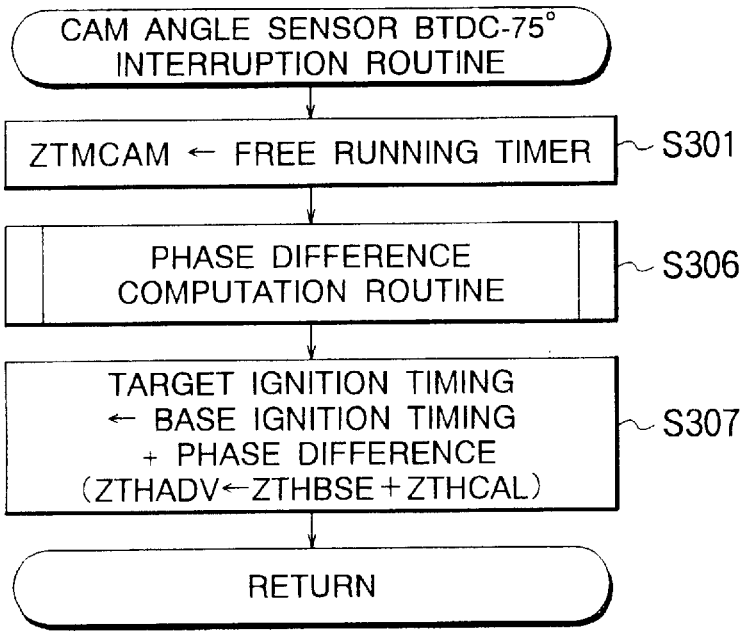
FIG. 3 is a flowchart for explaining the computation operation of the target ignition timing of the engine control apparatus according to the first embodiment of the present invention.
Figure 4:
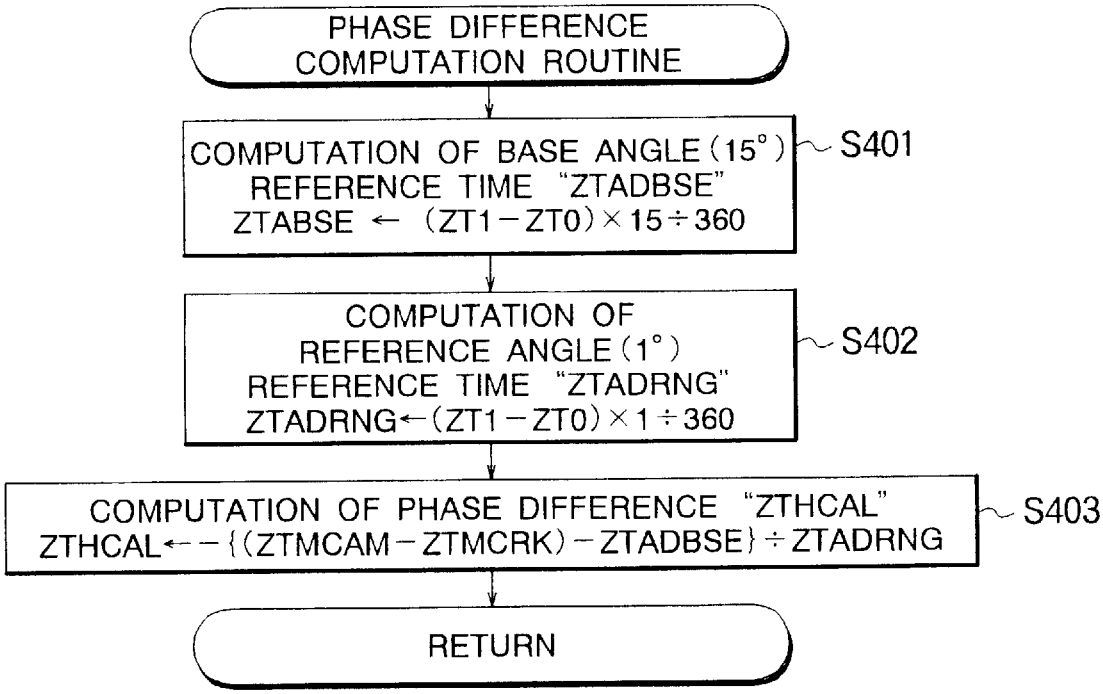
FIG. 4 is a flowchart for explaining the computation operation of the phase difference of the engine control apparatus according to the first embodiment of the present invention.
Figure 5:
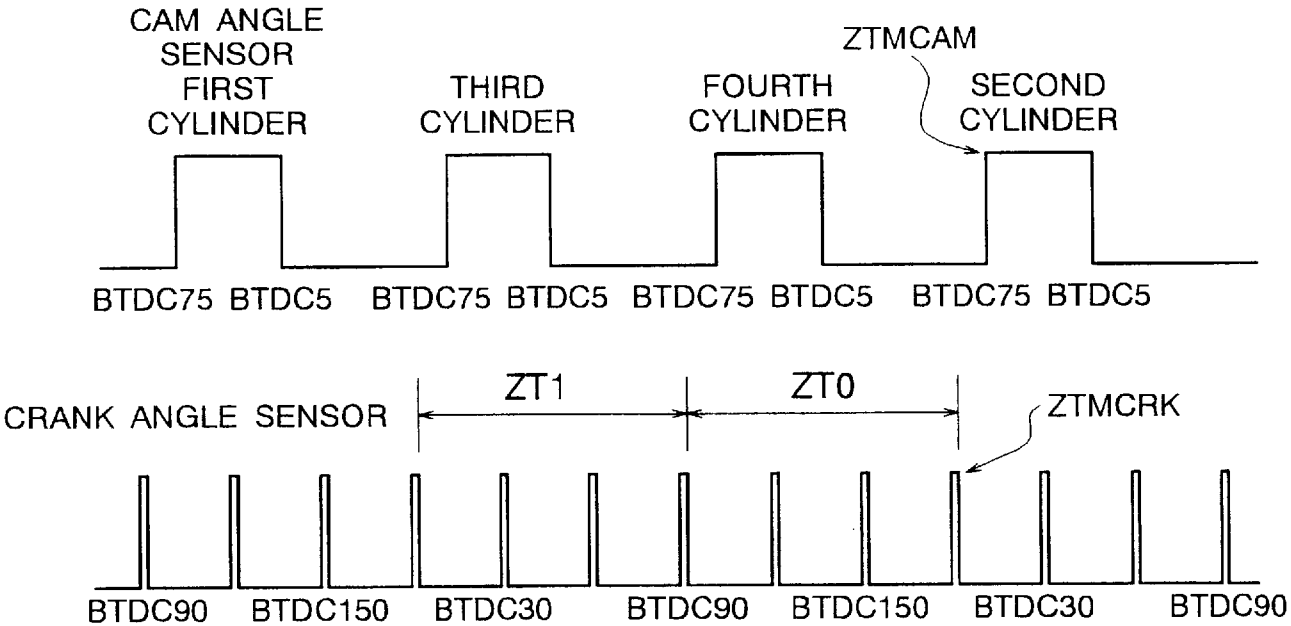
FIG. 5 is a timing chart showing the relationship between the cam-angle sensor and the crank angle sensor according to the first embodiment.

Now, this embodiment will be described in reference to the drawings. FIG. 2 is a flowchart for showing a crank angle sensor BTDC 90° interruption routine which is called out at intervals of crank angle 90° that is detected with the crank angle sensor 9 as shown in FIG. 5. FIG. 3 is a flowchart for showing a cam angle sensor BTDC 75° interruption routine which is called out at intervals of cam angle 75° that is detected with the cam angle sensor 8 as shown in FIG. 5. FIG. 4 is a flowchart for showing a phase difference computation routine which is called out during the cam angle sensor BTDC 75° interruption routine of FIG. 3. FIG. 5 is a timing chart showing the relationship between the cam angle and the crank angle.

The operation of this embodiment will hereinafter be described in reference to the flowcharts and the timing chart. First, in step S201 of the flowchart of FIG. 2, when this interruption occurs (at a crank angle of 90° before TDC), a free-running timer count value within the CPU 12 at that time is stored on the current crank angle BTDC 90° time value ZTMCRK in the RAM 14.

Next, in step S202 a difference between the last crank angle BTDC 90° time value ZTMCRK1 and the last but one crank angle BTDC 90° time value ZTMCRK2, stored in the RAM 14, is computed to obtain the last crank angle BTDC 90° cycle time ZT1. In step S203 a difference between the current crank angle BTDC 90° time value ZTMCRK and the last crank angle BTDC 90° time value ZTMCRK1 is computed to obtain the current crank angle BTDC 90° cycle time ZT0, and the interruption processing is ended.

Subsequently, in step S301 of the flowchart of FIG. 3, when this interruption takes place (at a cam angle of 75° before TDC), the free-running timer count value within the CPU 12 at that time is stored on the cam angle BTDC 75° time value ZTMCAM in the RAM 14. In step S306 the phase difference computation routine shown in FIG. 4 (to be described later) is called out, and in the routine the phase difference ZTHCAL between the crank angle sensor and the cam angle sensor is computed.

In the phase difference computation routine, in step S401 base angle (15°) reference time ZTADBSE is first computed based on the ZT1 and ZT0 obtained in step S202 and step S203 of FIG. 2 by the following equation:

$$ZTADBSE=(ZT1-ZT0)\times 15\div 360$$

Subsequently, in step S402 reference angle (1°) reference time ZTADRNG is computed as follows:

$$ZTADRNG=(ZT1-ZT0)\times 1\div 360$$

Based on these computation results, in step S403 the phase difference ZTHCAL is computed as follows:

$$ZTHCAL=-\{(ZTMCAM-ZTMCRK)-ZTADBSE\}+ZTADRNG$$

where (ZTMCAM−ZTMCRK) represents the elapsed time from the crank angle BTDC 90° to the cam angle BTDC 75°.

If the aforementioned computation is performed and this routine is ended, then the routine will advance to step S307 of FIG. 3, and the sensor phase difference ZTHCAL will be added to the base ignition timing ZTHBSE obtained in a method to be described later in order to determine target ignition timing ZTHADV.

The base ignition timing ZTHBSE is computed, for example, by mapping the two-dimensional map in the ROM 13 based on an actual engine speed obtained from the output of the crank angle sensor 9 and based on the filling efficiency obtained from the intake quantity detected by the air flow sensor.

$$ZTHADV=ZTHBSE+ZTHCAL$$

After the target ignition timing ZTHADV has been determined by this computation, this interruption processing is ended and the engine is ignited based on the target ignition timing ZTHADV.

(Second Embodiment)

A second embodiment will next be described in reference to the drawings. This second embodiment prevents a computation error which is caused by the instantaneous measurement error between the crank angle sensor and the cam angle sensor caused due to engine speed variation, by averaging the computed phase differences ZTHCALs.

Figure 6:
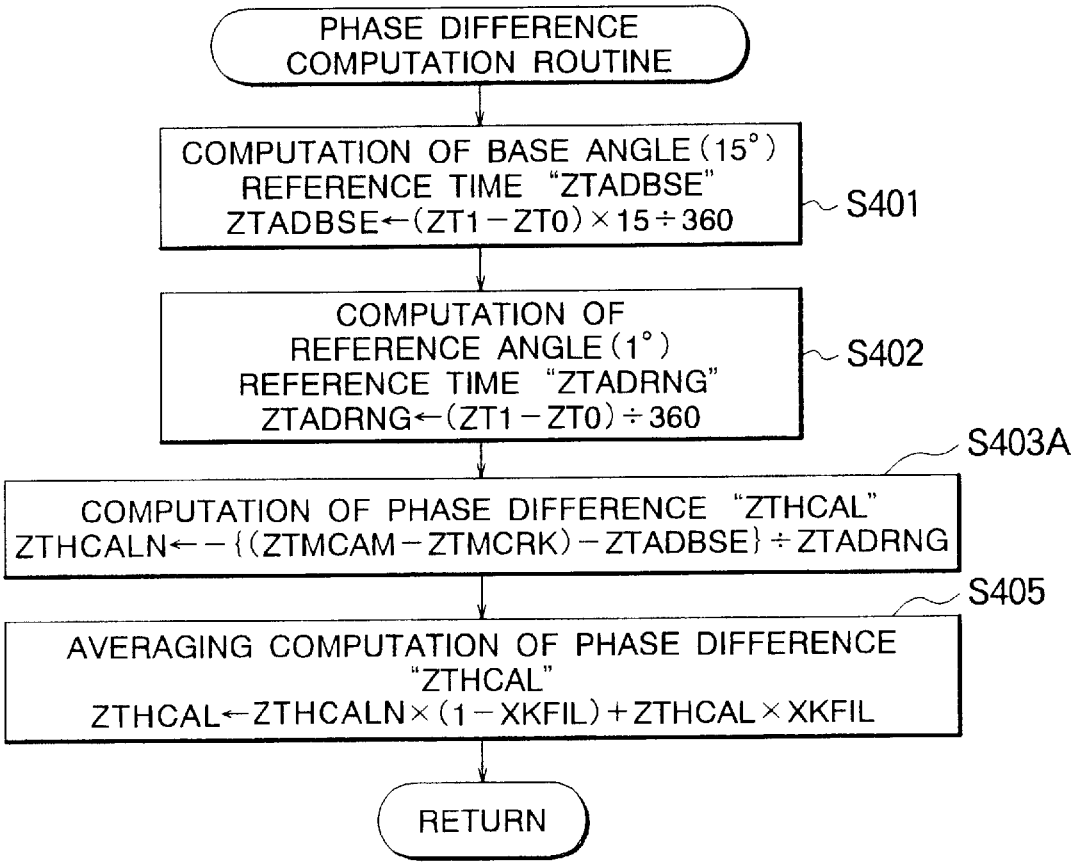
FIG. 6 is a flowchart for explaining the computation operation of the phase difference of an engine control apparatus according to a second embodiment of the present invention.

FIG. 6 is a flowchart showing a phase difference computation routine for averaging phase difference computation results. In this phase difference computation routine, the processing in step S401 and step S402 is the same as the processing in step S401 and step S402 in the flowchart of FIG. 4. In step S403A the calculated phase difference ZTHCAL is stored as an instantaneous phase difference ZTHCALN on the RAM 14. In step S405 the current phase difference average ZTHCAL is computed from the phase difference average ZTHCAL until the last time and the instantaneous phase difference ZTHCALN by the following equation.

$$ZTHCAL=ZTHCALN(1-XKFIL)+ZTHCAL\times XKFIL$$

where XKFIL is an averaging coefficient and a rate representing the degree of reflection of the previous phase difference average until the last time.

(Third Embodiment)

In the first and second embodiments, while the phase difference has been computed regardless of the operating state (engine speed) of the engine, in this embodiment the phase difference computation is made when the engine speed is within a range of predetermined speed.

Figure 7:
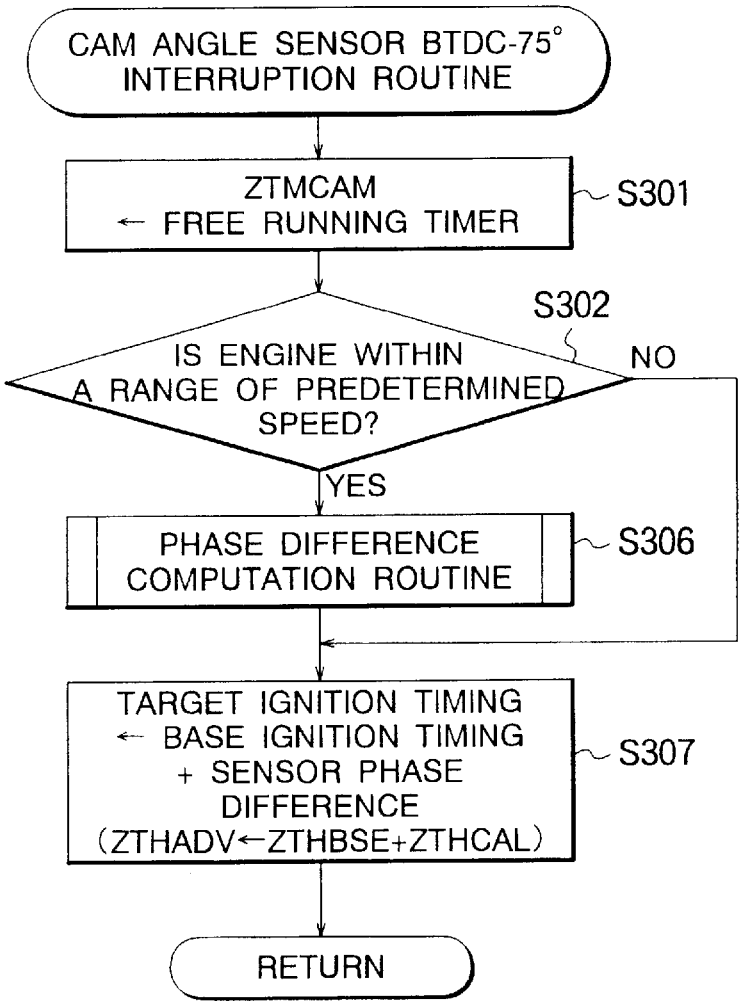
FIG. 7 is a flowchart for explaining the operation of judgment of the phase difference computation of an engine control apparatus according to a third embodiment of the present invention.

FIG. 7 is a flowchart showing a cam angle sensor BTDC 75° interruption routine. In this routine, the processing in step S301, step S306, and step S307 is the same as the processing in step S301, step S306, and step S307 in the flowchart of FIG. 3.

In step S302 it is judged whether the engine speed is greater or less than a predetermined speed (for example, speed between 700 and 1500 rpm). If it is greater or less, step S306 will not be carried out and target ignition timing ZTHADV will be computed based on the last sensor phase difference ZTHCAL and base ignition timing ZTHBSE. However, if the engine speed is within the predetermined speed, in step S306 phase difference computation will be carried out and step S306 will advance to step S307. In step S307 the target ignition timing is obtained by a computation equation of ZTHADV=ZTHBSE+ZTHCAL.

(Fourth Embodiment)

Although the objects of the aforementioned second and third embodiments is to eventually obtain the target ignition timing from the phase difference ZTHCAL between the crank angle sensor and the cam angle sensor, it is the object of this embodiment to correct for the target injection timing in correspondence with a phase difference.

Figure 8:
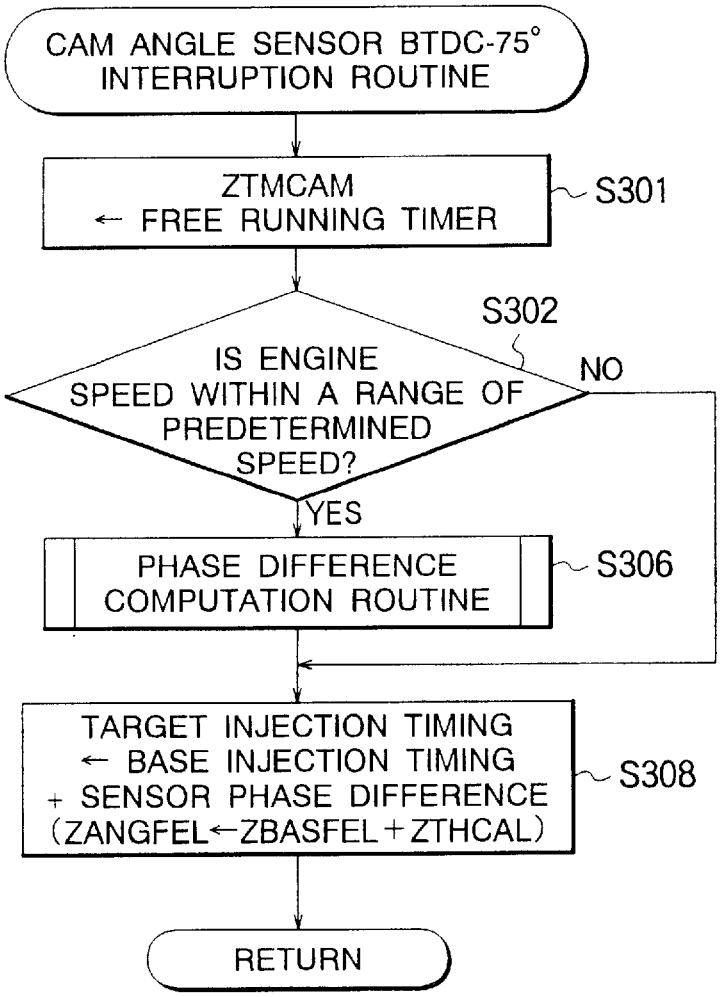
FIG. 8 is a flowchart for explaining the computation operation of the target injection timing of an engine control apparatus according to a fourth embodiment of the present invention.

This embodiment will next be described in reference to the drawings. FIG. 8 shows a cam angle sensor BTDC 75° interruption routine. In this routine, the processing in step S301, step S302, and step S306 is the same as the processing in step S301, step S302, and step S306 in FIG. 7. In step S308 the sensor phase difference ZTHCAL is added to the base injection timing ZBASFEL obtained in a method to be described later, in accordance with the following equation. After target injection timing ZANGFEL has been determined, this interruption processing is ended.

$$ZANGFEL=ZBASFEL+ZTHCAL$$

The base injection timing ZBASFEL is computed, for example, by mapping the two-dimensional map in the ROM 13 based on an actual engine speed obtained from the output of the crank angle sensor 8 and on the filling efficiency obtained from the intake quantity detected by the air flow sensor.

(Fifth Embodiment)

In the aforementioned third and fourth embodiments, if the engine speed is within a range of predetermined speed, the sensor phase has been calculated and, based on the computation result, the target ignition timing and the target injection timing have been corrected. However, in this embodiment, the phase difference computation routine will be carried out if the engine speed is within a range of predetermined speed and also has a small engine speed variation.

This embodiment will next be described in reference to FIG. 9.

Figure 9:
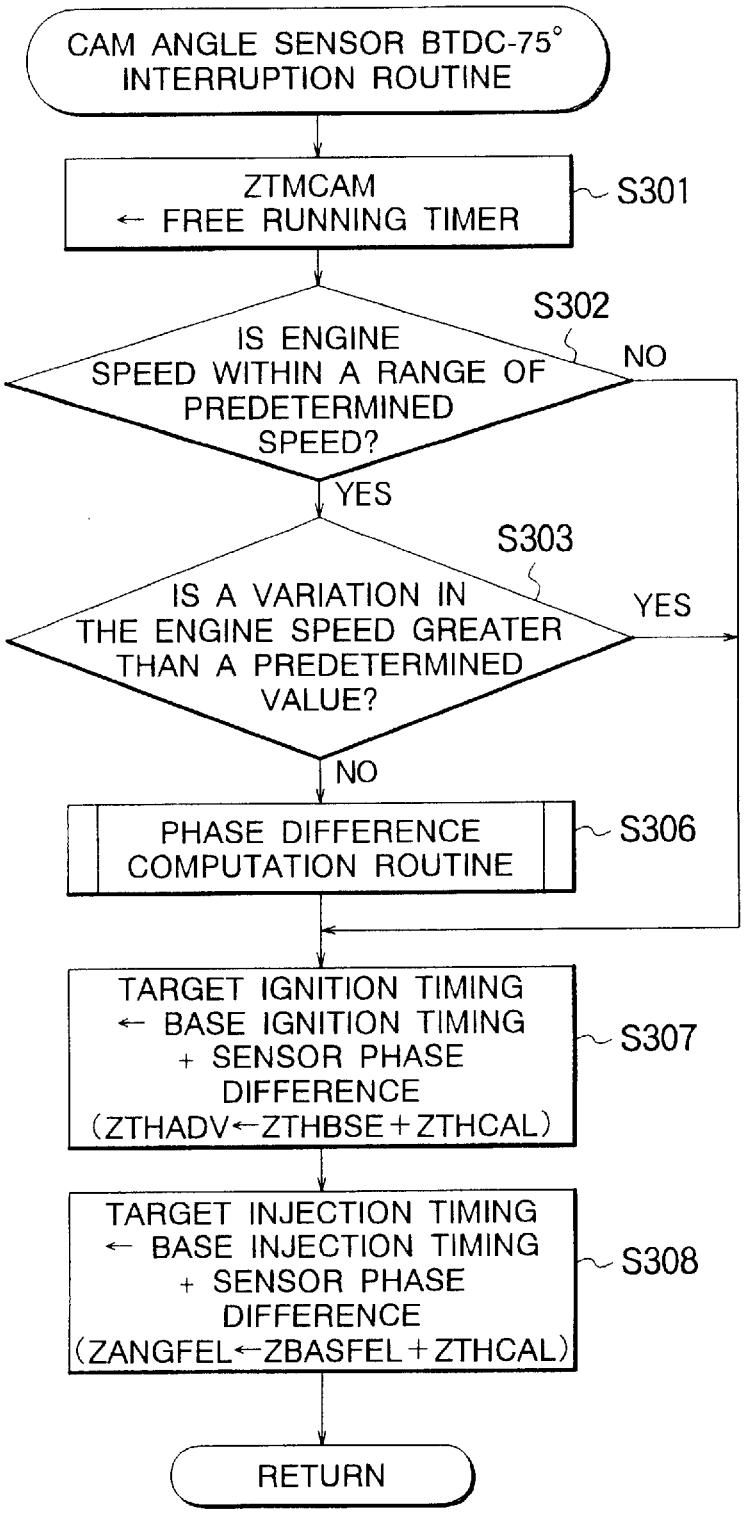
FIG. 9 is a flowchart for explaining the computation operation of the target injection timing of an engine control apparatus according to a fifth embodiment of the present invention.

FIG. 9 shows a cam angle sensor BTDC 75° interruption routine. In this routine, the processing in step S301, step S302, step S306, step S307, and step S308 is the same as the processing in step S301, step S302, step S306, step S307, and step S308 in FIGS. 7 and 8.

In step S303 it is judged whether a variation in the engine speed is greater or less than a predetermined value. If it is greater, step S306 will not be carried out and step S303 will advance to step S307. In step S307, the target ignition timing ZTHADV is corrected based on the last sensor phase difference ZTHCAL. Then, in step S308 the target injection timing ZANGFFL is corrected based on the last sensor phase difference ZTHCAL.

Note that in order to obtain a variation in the engine speed, there are various method such as a method of computing the difference between the engine speed at the last interruption and the engine speed at the current interruption.

(Sixth Embodiment)

Figure 10:
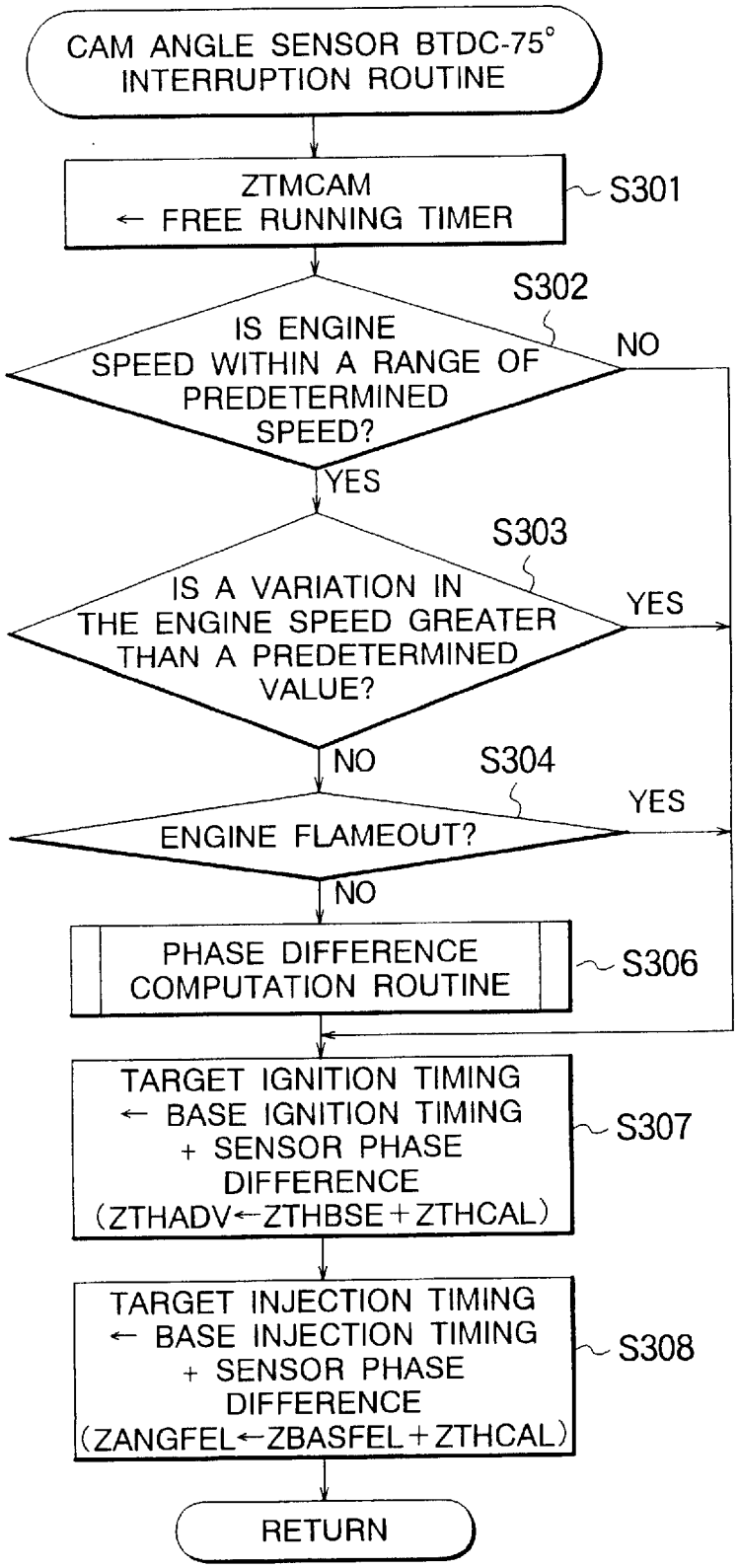
FIG. 10 is a flowchart for explaining the computation operation of the target injection timing of an engine control apparatus according to a sixth embodiment of the present invention.

This embodiment adds a processing step of judging a state of engine flameout in addition to the processing steps in the aforementioned fifth embodiment. This embodiment will next be described in reference to FIG. 10. FIG. 10 shows a cam angle sensor BTDC 75° interruption routine. In this routine, steps other than step S304 are the same as those of FIG. 9.

In step S304 it is judged whether the engine is in the flameout state. If it is in the flameout state, step S306 will not be carried out and step S304 will advance to step S307. In step S307, the target ignition timing ZTHADV is corrected based on the last sensor phase difference ZTHCAL. Then, in step S308 the target injection timing ZANGFFL is corrected based on the last sensor phase difference ZTHCAL.

On the other hand, if the flameout state is not judged, step S306 will be carried out to compute a phase difference. In step S307, the target ignition timing ZTHADV is corrected based on the computed sensor phase difference ZTHCAL. Furthermore, in step S308 the target injection timing ZANGFFL is corrected based on the computed sensor phase difference ZTHCAL.

Note that there are various methods for judging engine flameout state, such as a method making use of a fluctuation in the cycle of the output signal of the crank angle sensor.

(Seventh Embodiment)

Figure 11:
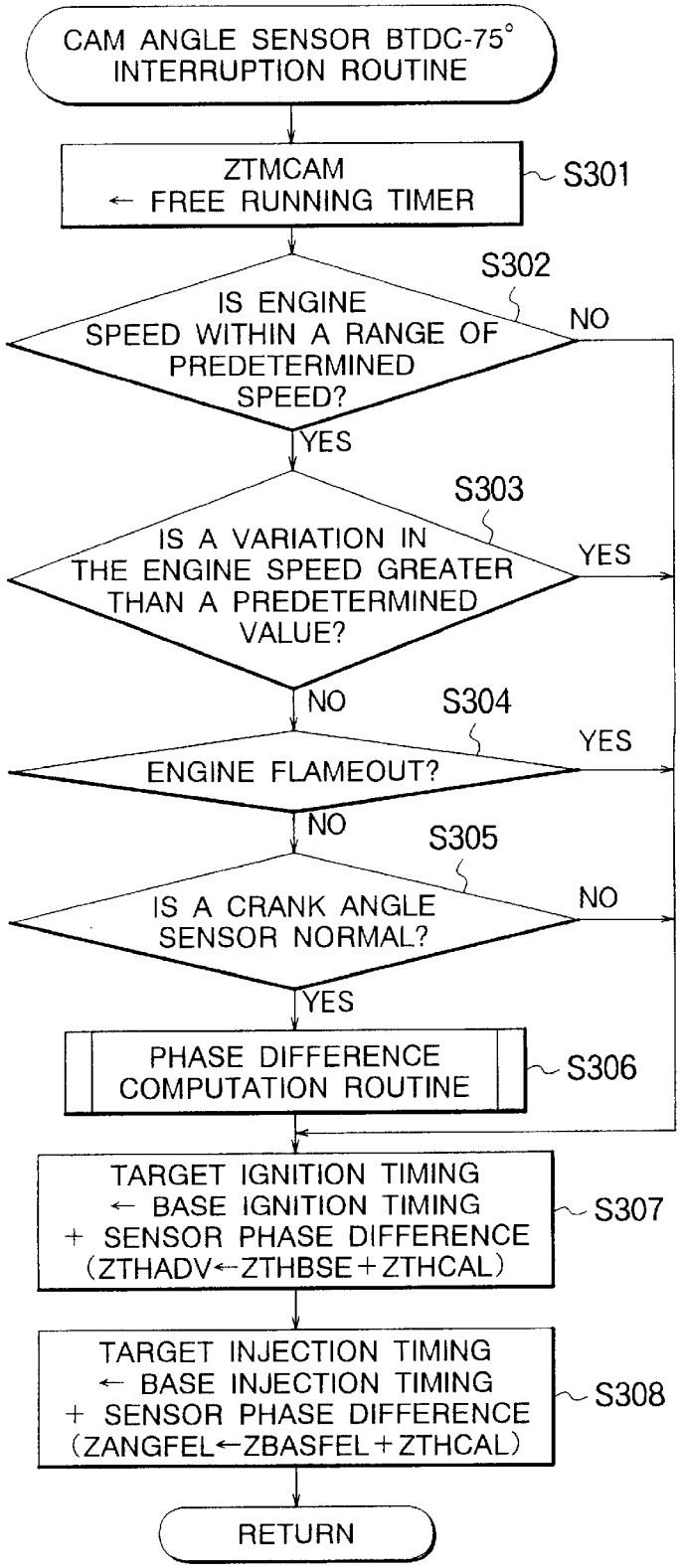
FIG. 11 is a flowchart for explaining the computation operation of the target injection timing of an engine control apparatus according to a seventh embodiment of the present invention.

The operation of this embodiment will next be described in reference to FIG. 11. FIG. 11 shows a cam angle sensor BTDC 75° interruption routine. In this routine, steps other than step S305 are the same as those of FIG. 10. After it has been judged that there is no flameout state, in step S305 the failure state of the crank angle sensor is judged. If it is judged that the sensor has failed, step S306 will not be carried out and step S305 will advance to step S307. In step S307, the target ignition timing ZTHADV is corrected based on the last sensor phase difference ZTHCAL. Then, in step S308 the target injection timing ZANGFFL is corrected based on the last sensor phase difference ZTHCAL.

On the other hand, if the failure state has not been judged, step S306 will be carried out to compute a phase difference. In step S307, the target ignition timing ZTHADV is corrected based on the computed sensor phase difference ZTHCAL. Furthermore, in step S308 the target injection timing ZANGFFL is corrected based on the computed sensor phase difference ZTHCAL.

Note that as the method of judging the failure state of the crank angle sensor, there is a method which judges failure state by the fact that an input signal from the crank angle sensor is not input, although the engine is rotating.

(Eighth Embodiment)

This embodiment identifies a cylinder in which the cam angle detected by the cam angle sensor is in a state of 75° from TDC before ignition, and then computes the target ignition timing and target injection timing of the identified cylinder.

Figure 12:
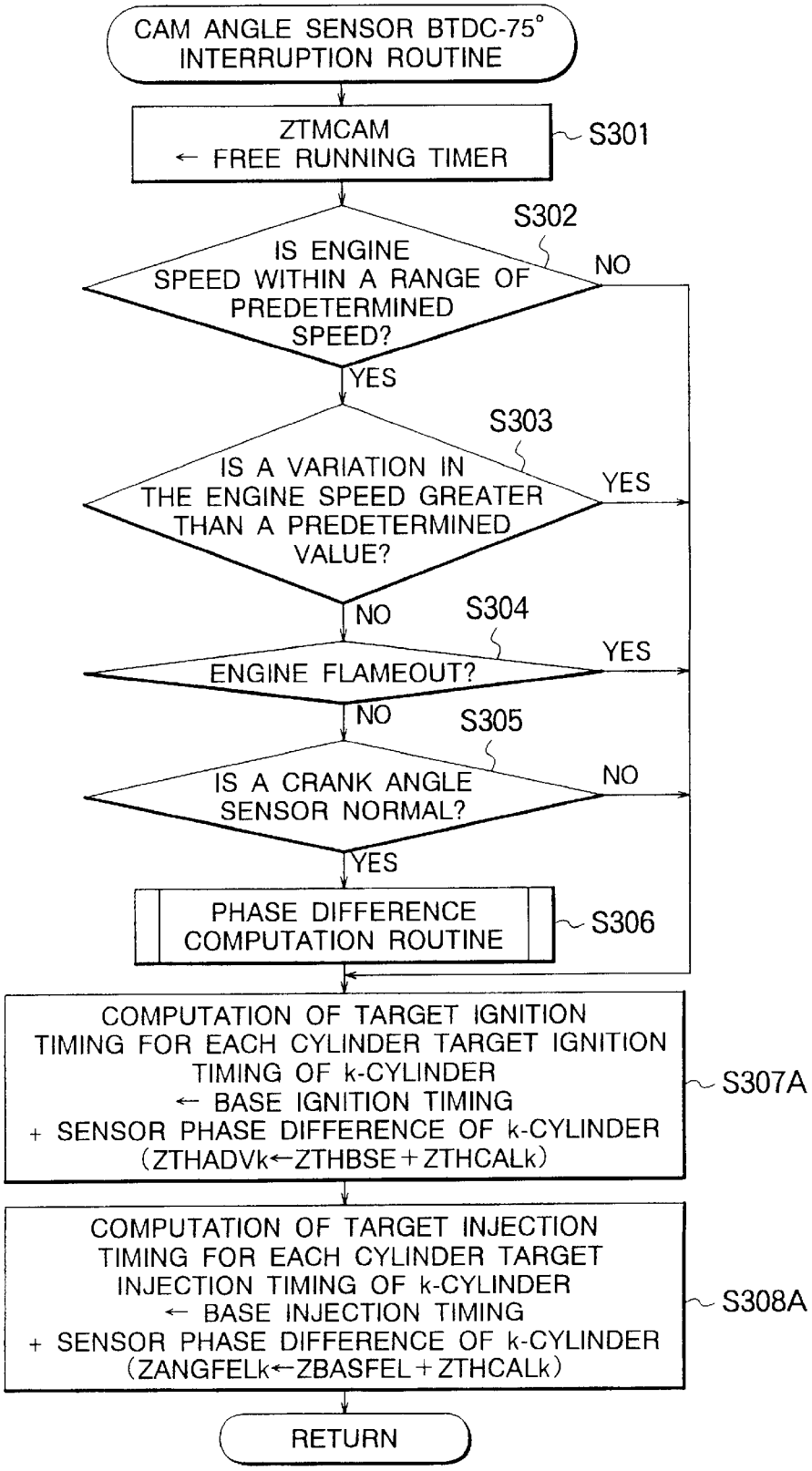
FIG. 12 is a flowchart for explaining the computation operation of the target ignition timing and target injection timing of each cylinder of an engine control apparatus according to an eighth embodiment of the present invention.

The operation of this embodiment will next be described in reference to FIGS. 12 and 13. FIG. 12 is a flowchart for describing the cam angle sensor BTDC 75° interruption routine according to this embodiment. In the steps of this routine, step S301 through step S305 are the same as step S301 through step S305 in FIG. 11. Step 306 is a phase difference computation routine that is described in detail by the flowchart of FIG. 13.

After similar processing as the steps S401 through S403A in the flowchart of FIG. 6 has been performed to compute the phase difference ZTHCALN, a cylinder in which the cam angle is at 75° before TDC and which is in a state before ignition is detected as the current cylinder. For a cylinder in such state, the phase difference average ZTHCALK of the current cylinder is computed from the phase difference ZTHCALN computed in step S403A and the phase difference average ZTHCALk computed in the last phase difference average computation routine.

However, if in step S404K the cylinder in the aforementioned state is not a k-cylinder, step S404K will advance to step S404M. In step S404M, if the current cylinder is an m-cylinder, step S404M will advance to step S405M. In step S405M the phase difference average ZTHCALm of the m-cylinder is computed in a similar way as step S405 of FIG. 6. (Note that the phase difference average ZTHCALm until the last time uses the value of the phase difference average ZTHCALm obtained in the average computation of the last m-cylinder phase difference ZTHCALm.)

However, if in step 404M it is judged that the cylinder is not an m-cylinder, then step 404M will advance to step S404X. In step S404X the phase difference between respective cylinders is computed, and this routine is ended.

The operation of this embodiment will next be described in reference to FIGS. 12 and 13.

First, if in step 305 of the flowchart shown in FIG. 12 it is judged that the crank angle sensor is normal, then step 305 will advance to step 306A in which a phase computation routine is performed.

Figure 13:
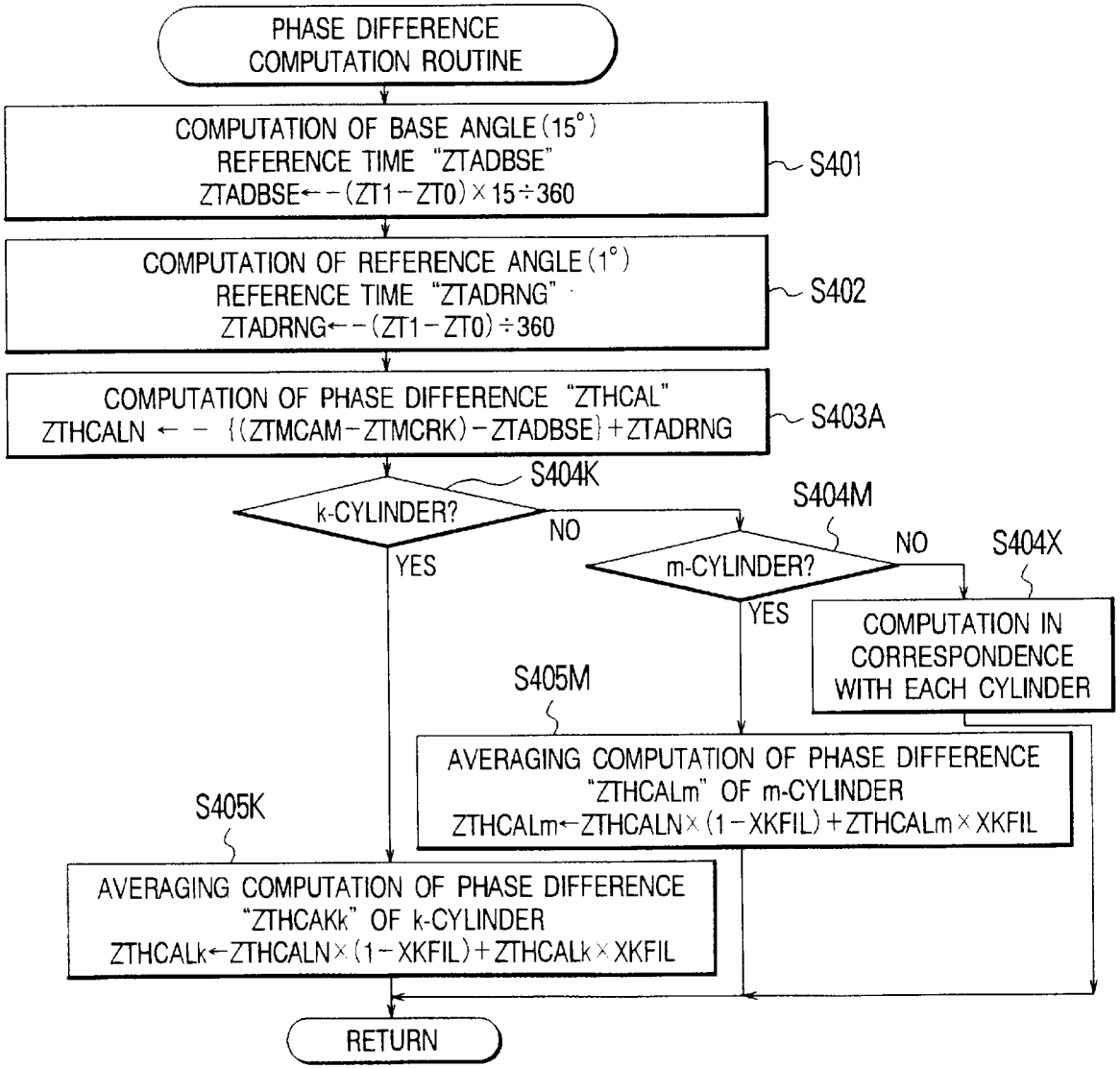
FIG. 13 is a flowchart for explaining the computation operation of the phase difference of each cylinder of the engine control apparatus according to the eighth embodiment of the present invention.

In the phase computation routine in step 306A, the base angle (15°) reference time ZTADBSE and the reference angle (1°) reference time ZTADRNG are computed through steps S401 to S403A, respectively, and based on each computation result, the phase difference ZTHCAL is computed, as shown in the flowchart of FIG. 13.

Next, in step 404K the current cylinder is judged. If it is a k-cylinder, step 404K will advance to step S405K. In step S405K the phase difference average ZTHCALk of the k-cylinder is computed in a similar way as step S405 of FIG. 6. (Note that the phase difference average ZTHCALk until the last time uses the value of the phase difference average ZTHCALk obtained in the average computation of the last k-cylinder phase difference ZTHCALk.)

If in the phase difference computation routine the current cylinder is detected, for example, as a k-cylinder and if the k-cylinder phase difference ZTHCALk is computed, then step 306A will advance to step S307A of the cam angle sensor BTDC 75° interruption routine shown in FIG. 12. In step S307A the k-cylinder sensor phase difference average ZTHCALk is added to the base ignition timing ZTHBSE to compute the target ignition timing ZTHADVk of the k-cylinder. Next, step S307A advances to step 308A, and the k-cylinder sensor phase difference average ZTHCALk is added to the base injection timing ZBASFEL to compute the target injection timing ZANGFELk of the k-cylinder.

As has been described hereinbefore, the engine control apparatus according to the present invention is constructed so that it comprises crank angle detection means for detecting a crank angle of an engine, cam angle detection means for detecting a cam angle of the engine, phase difference computation means for computing a phase difference between the crank angle and the cam angle from the result of the detection of the crank angle detection means and the result of the detection of the cam angle detection means, and timing control means for performing correction of the control timing of the engine, based on the result of the phase difference computation by the phase difference computation means. Accordingly, the present invention has the advantage that an offset in the reference angle due to an offset in the attached position of the distributor can be automatically corrected without errors and also the control timing of the engine can be made proper.

In the engine control apparatus of the present invention, the timing control means has performed correction of the ignition timing of the engine, based on the phase difference computation result. Accordingly, the present invention has the advantage that an offset in the reference angle due to an offset in the attached position of the distributor can be automatically corrected without errors and also the ignition timing of the engine can be made proper.

In the engine control apparatus of the present invention, the timing control means has also performed correction of the fuel injection timing of the engine, based on the phase difference computation result. Accordingly, the present invention has the advantage that an offset in the reference angle due to an offset in the attached position of the distributor can be automatically corrected without errors and also the fuel injection timing of the engine can be made proper.

The engine control apparatus has further included phase difference average computation means for computing an average value of the phase differences computed by the phase difference computation means, and the timing control means has performed correction operation, based on the average value of the phase differences. Accordingly, the present invention has the advantage that it can prevent an error of computation which is caused by an instantaneous error of measurement between the crank angle sensor and the cam angle sensor due to a variation in the engine speed.

Also, the engine control apparatus has included engine speed detection means for detecting engine speed and judgment means which judges whether or not the detected engine speed is within a range of predetermined speed. When it is judged that the engine speed is not within the range of predetermined speed, the judgement means judges that phase difference computation conditions are unestablished, with respect to the phase difference computation means. Therefore, in the case where there is the possibility that errors will occur in the measured values of the crank angle sensor and the cam angle sensor when the engine speed goes out of a predetermined speed range, the present invention has the advantage that a computation of phase difference with less errors can be made, because the phase difference computation is not carried out.

In addition, the engine control apparatus has included speed variation detection means for detecting a variation in the speed of the engine and judgment means which judges whether or not the variation in the speed of the engine detected is greater than a predetermined value. When it is judged that the variation is greater than the predetermined value, the judgement means judges that phase difference computation conditions are unestablished, with respect to the phase difference computation means. Therefore, in the case where there is the possibility that errors will occur in the measured values of the crank angle sensor and the cam angle sensor due to a variation in the engine speed, the present invention has the advantage that a computation of phase difference with less errors can be made, because the phase difference computation is not carried out.

Furthermore, the engine control apparatus has included engine flameout detection means for detecting flameout state of the engine and judgment means which, when the flameout state of the engine is detected, judges that phase difference computation conditions are unestablished, with respect to the phase difference computation means. Therefore, in the case where there is the possibility that errors will occur in the measured values of the crank angle sensor and the cam angle sensor due to engine flameout, the present invention has the advantage that a computation of phase difference with less errors can be made, because the phase difference computation is not carried out.

Moreover, the engine control apparatus has included crank angle sensor failure detection means for detecting failure of the crank angle sensor and judgment means which, when the failure of the crank angle sensor is detected, judges that phase difference computation conditions are unestablished, with respect to the phase difference computation means. Therefore, in the case where there is the possibility that errors will occur in the measured values of the crank angle sensor and the cam angle sensor due to crank angle sensor failure, the present invention has the advantage that a computation of phase difference with less errors can be made, because the phase difference computation is not carried out.

In the engine control apparatus of the present invention, the phase difference computation means has computed a phase difference between the crank angle and the cam angle for each cylinder, and based on the result of the phase difference computation, the timing control means has performed correction of the control timing of the engine. Accordingly, the present invention has the advantage that the physical manufacturing error of the cam angle sensor can be corrected for each cylinder.

What is claimed is:

1. An engine control apparatus comprising:

crank angle detection means for detecting a crank angle of an engine;

cam angle detection means for detecting a cam angle of said engine;

phase difference computation means for computing a phase difference between said crank angle and said cam angle from the result of the detection of said crank angle detection means and the result of the detection of said cam angle detection means; and timing control means for performing correction of the control timing of said engine by adding the result of the phase difference computation by said phase difference computation means to a fundamental controlled quantity of the engine.

2. The engine control apparatus as set forth in claim 1, wherein said fundamental controlled quantity of the engine is an ignition period, and said timing control means performs correction of the ignition timing of said engine by adding the phase difference computation result to the ignition period.

3. The engine control apparatus as set forth in claim 1, wherein said fundamental controlled quantity of the engine is a fuel injection period, and said timing control means performs correction of the fuel injection timing of said engine by adding the phase difference computation result to the fuel injection period.

4. The engine control apparatus as set forth in claim 1, further comprising phase difference computation means for computing an average value of the phase differences computed by the phase difference computation means, and wherein said timing control means performs correction operation, based on the average value of the phase differences.

5. The engine control apparatus as set forth in claim 1, further comprising:

engine speed detection means for detecting engine speed; and judgment means which, when the engine speed is not within a range of predetermined speed, judges that phase difference computation is undesirable and therefore bypasses said phase difference computation means.

6. The engine control apparatus as set forth in claim 1, further comprising:

speed variation detection means for detecting a variation in the speed of said engine; and judgment means which, when the variation is greater than a predetermined value, judges that phase difference computation is undesirable and therefore bypasses said phase difference computation means.

7. The engine control apparatus as set forth in claim 1, further comprising:

engine flameout detection means for detecting flameout state of the engine; and judgment means which, when the flameout state of the engine is detected, judges that phase difference computation is undesirable and therefore bypasses said phase difference computation means.

8. The engine control apparatus as set forth in claim 1, further comprising:

crank angle sensor failure detection means for detecting failure of the crank angle sensor; and judgment means which, when the failure of the crank angle sensor is detected, judges that phase difference computation is undesirable and therefore bypasses said phase difference computation means.

9. An engine control apparatus comprising:

crank angle detection means for detecting a crank angle of an engine;

cam angle detection means for detecting a cam angle of said engine;

phase difference computation means for computing a phase difference between said crank angle and said cam angle from the result of the detection of said crank angle detection means and the result of the detection of said cam angle detection means, wherein said phase difference computation means computes a phase difference between said crank angle and said cam angle for each cylinder; and timing control means for performing correction of the control timing of each cylinder of said engine, based on the result of the phase difference computation by said phase difference computation means.

10. The engine control apparatus as set forth in claim 9, wherein said timing control means performs correction of the ignition timing of said engine, based on the phase difference computation result.

11. The engine control apparatus as set forth in claim 9, wherein said timing control means performs correction of the fuel injection timing of said engine, based on the phase difference computation result.

* * * * *